United States Patent [19]

Kudler

[11] Patent Number: 4,522,390

[45] Date of Patent: Jun. 11, 1985

[54] BUMPER CAR RIDE

[75] Inventor: Paul S. Kudler, New Waterford, Ohio

[73] Assignee: Majestic Rides Mfg. Co., New Waterford, Ohio

[21] Appl. No.: 608,176

[22] Filed: May 8, 1984

[51] Int. Cl.[3] ..... A63G 1/10; E04B 1/344; E04H 3/10

[52] U.S. Cl. ..... 272/29; 52/69; 52/70; 52/79.6; 180/2.1; 272/35

[58] Field of Search ..... 272/29, 3, 4, 34, 35; 180/2.1, 220, 279; 105/328, 363, 370, 371, 372; 52/68, 69, 70, 79.5, 79.6, 143

[56] References Cited

U.S. PATENT DOCUMENTS

| | | | |
|---|---|---|---|
| 1,373,108 | 3/1921 | Stoehrer et al. | 180/2.1 |
| 1,919,986 | 7/1933 | Powers | 52/69 X |
| 2,015,176 | 9/1935 | Ebenhack | 52/69 |
| 2,886,856 | 5/1959 | Che | 52/69 |
| 3,724,842 | 4/1973 | Wisdom | 272/29 |

FOREIGN PATENT DOCUMENTS

| | | | |
|---|---|---|---|
| 1807816 | 5/1970 | Fed. Rep. of Germany | 272/29 |
| 2310786 | 12/1976 | France | 272/29 |
| 529401 | 2/1958 | Italy | 52/68 |

*Primary Examiner*—Robert A. Hafer
*Assistant Examiner*—Arnold W. Kramer
*Attorney, Agent, or Firm*—Harpman & Harpman

[57] ABSTRACT

A structure on which electrically driven amusement bumper cars are operable comprises a trailer with fixed and fold out floor sections on a common level and fixed and fold out ceiling sections on an elevated level with respect thereto for supplying electrical energy to trolley equipped bumper cars.

5 Claims, 4 Drawing Figures

BUMPER CAR RIDE

BACKGROUND OF THE INVENTION

1. Technical Field

This invention relates to amusement car rides which provide an operating and energizing structure for electrically driven bumper cars.

2. Description of the Prior Art

Amusement bumper car rides heretofore known in the art have used a platform formed of a number of flat panels joined to one another and having an electrically conducting surface on which the bumper cars operate. Thin metal panels, sometimes utilizing metal screen, are disposed horizontally above the platform and bumper cars equipped with trolleys engaging the metal panels or screen provide power for energizing the bumper cars. The prior art structure require assembly and disassembly of the several panels of the platform and the elevated current supplying panels.

The prior art structures in assembled relation frequently rendered the bumper cars inoperative by reason of the disengagement of the trolleys with the elevated current supplying panels.

This invention uses a trailer having an elongated flat floor and a plurality of hinged accordian foldable floor sections affixed to its opposite longitudinal edges to form a suitable platform. An elevated panel on the trailer with respect to the floor portion supports a plurality of accordian foldable metal or screen panels hinged to one another and slidable outwardly to a horizontal position above the platform supported on lightweight post and beam frames. Energizing electrical circuits connected with the fold out floor structure forming the platform and with the fold out ceiling panel sections enable electrically driven bumper cars with trolleys to operate on the floor structure. Downturned guard flanges on the fold out ceiling panel sections prevent the disengagement of the trolleys at the peripheral edges of the ceiling panel sections.

SUMMARY OF THE INVENTION

A portable amusement bumper car ride structure has an elongated trailer which serves as part of the bumper card ride structure when floor and ceiling sections are folded outwardly from the longitudinal sides thereof and as a transport medium when the floor and ceiling sections are folded inwardly toward one another and supported in vertically spaced positions on the trailer.

DESCRIPTION OF THE PREFERRED EMBODIMENT

Figure 1:
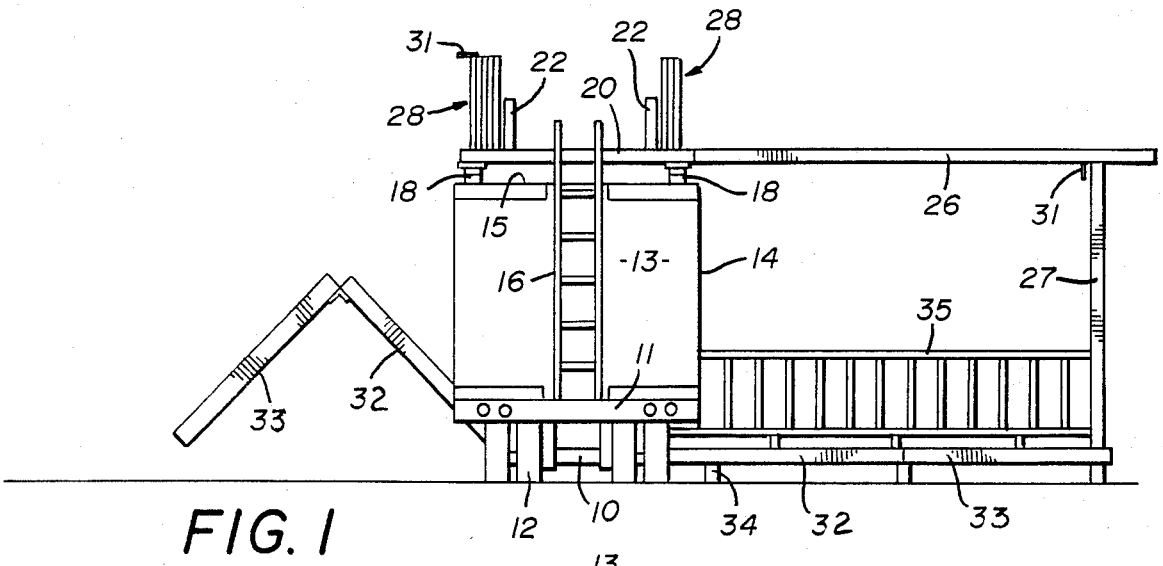
FIG. 1 is a back end elevation of a trailer showing floor and ceiling panel sections attached to the longitudinal sides thereof.
Figure 2:
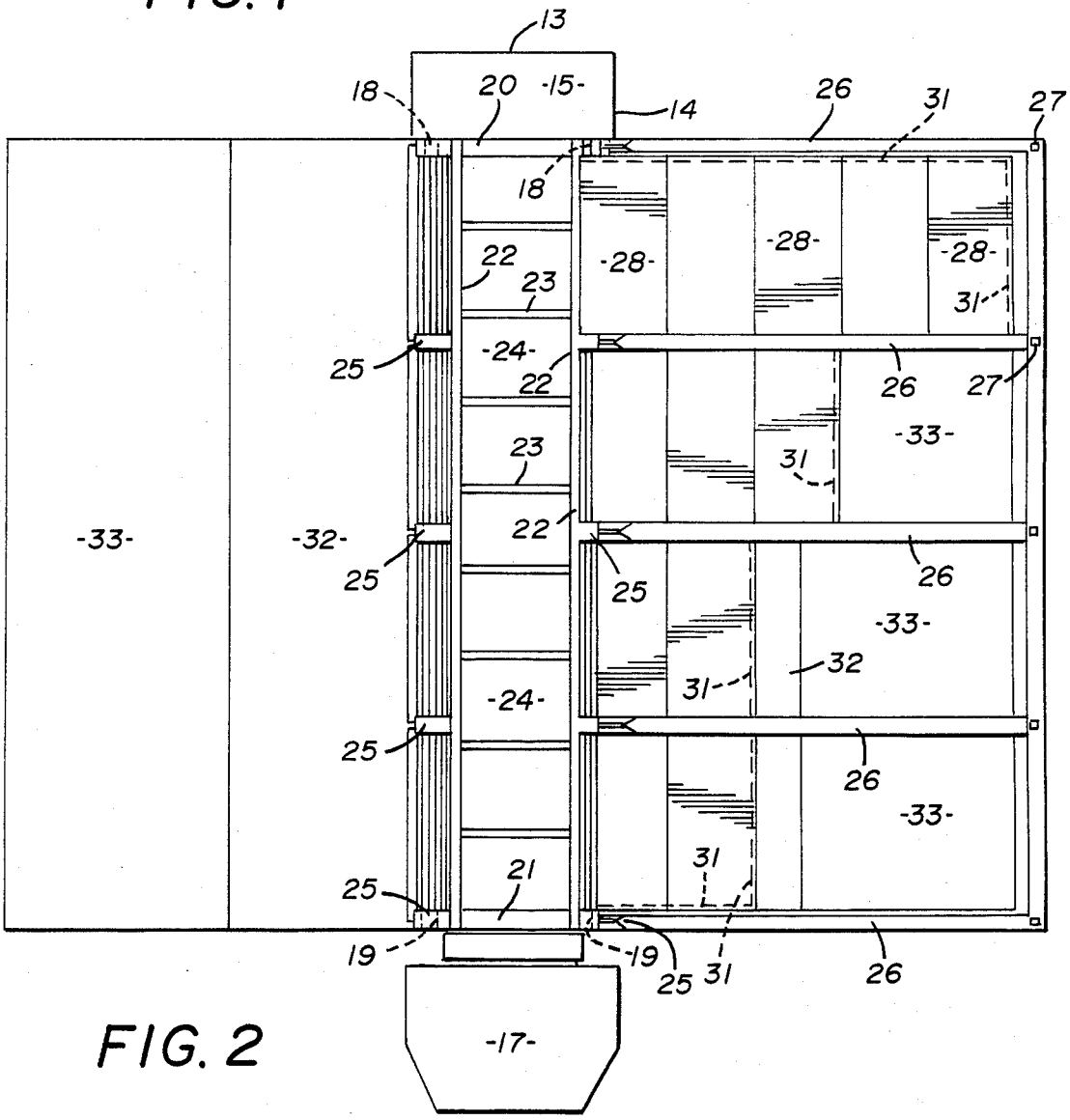
FIG. 2 is a top plan view of the trailer of FIG. 1 showing on the left side the floor sections completely extended and on the right side, some of the ceiling panel sections extended.

In the form of the invention chosen for illustration and as illustrated in FIGS. 1 and 2 of the drawings, an elongated trailer is shown with a fixed floor 10 with a fixed elevated rear end portion 11 which provides vertical clearance for ground engaging wheel assemblies 12 which support the trailer through vertically adjustable suspension means. A partial enclosure comprising back, side, and top walls 13, 14 and 15 respectively, is positioned on the elevated rear end portion 11 and an access ladder 16 is mounted on the exterior of the back wall 13. The opposite or front end of the trailer has a vertically movable folding goose neck 17 which in alignment with the trailer floor 10 forms an entrance platform and when elevated with respect thereto forms a forwardly extending structure that pivotally engages the fifth wheel of a towing vehicle, not shown, so that the trailer may be moved over a highway and the like.

Figure 3:
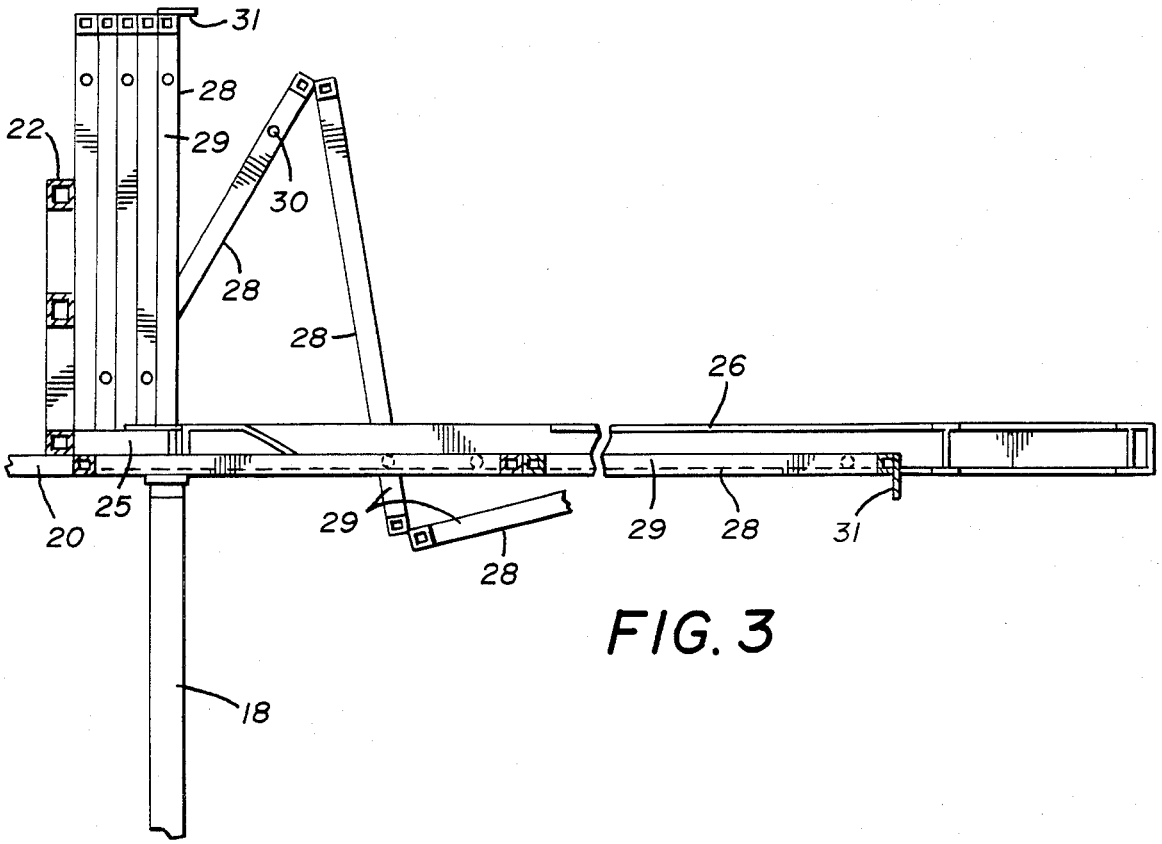
FIG. 3 is an enlarged detail with parts in cross section and parts broken away illustrating an upper portion of the trailer and a sidewardly extending ceiling panel support and several ceiling panels thereon.

A spaced pair of support posts 18 with insulators thereon are positioned on and secured to the rear end of the trailer adjacent the forward edges of the vertical side walls 14 and a similar pair of spaced posts 19 with insulator assemblies are positioned on and affixed to the front end of the trailer, the lower end as seen in FIG. 2 of the drawings, and adjacent the folding goose neck 17. Transverse frame members 20 and 21 respectively join the upper ends of the pairs of posts 18—18 and 19—19. A pair of longitudinally extending trusses 22, see FIGS. 2 and 3, are positioned on the transverse frames 20 and 21 and a plurality of longitudinally spaced frame members 23 join the lower chords of the longitudinally extending trusses 22. The lower surfaces of the trusses 22 and the secondary cross frames 23, see FIG. 2, support a plurality of metal panels 24 to which a suitable electrical conductor is connected. Sidewardly extending brackets 25 are positioned on the lower chords of the trusses 22 in longitudinally spaced relation and support the ends of a plurality of I-beams 26, the outer ends of which are supported on vertically positioned secondary posts 27.

A plurality of folding ceiling panel sections 28 are hinged together in accordian fashion and hinged to the outer sides of the lower chords of the trusses 22. Each of the ceiling panel sections 28 comprises a frame 29 to which the metal panels 28 are attached, see FIG. 4, so that when the folding ceiling panel sections 28 are extended outwardly with rollers 30 thereon supporting them the full length of the I-beams, the panels 28 form a continuous lower surface on a common horizontal plane with the metal panels 24 heretofore described. The folding ceiling panel sections 28 are electrically connected to one another through their interconnecting hinges and with the metal panels 24 so that when all of the ceiling panel sections 28 are positioned in side by side horizontal relation they form a ceiling and an electrical conductor against which trolleys on bumper cars with slidably engage.

Figure 4:
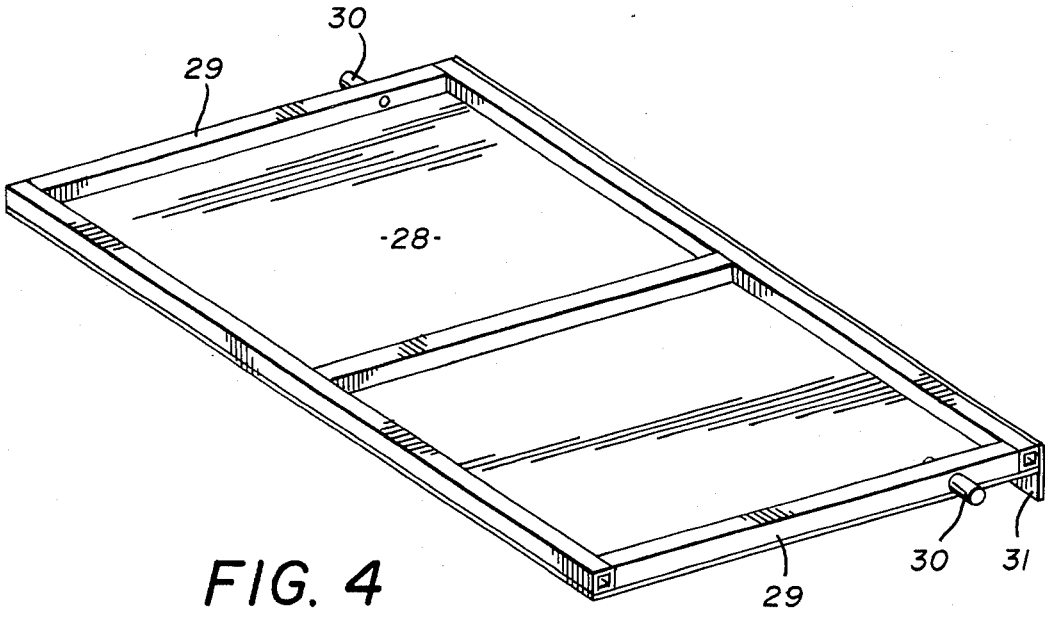
FIG. 4 is an enlarged top perspective view of one of the ceiling panels of FIGS. 2 and 3.

By referring now to FIGS. 1, 3 and 4 of the drawings, it will be seen that the outer edges of the ceiling panel sections 28 are provided with downturned guard flanges 31 which form the periphery of the horizontally disposed unfolded ceiling panel sections 28 and prevent trolleys on bumper cars becoming disengaged from the ceiling panel sections 28 as otherwise frequently occurs.

The downturned guard flanges 31 are formed on longitudinal edges of the ceiling panel sections 28 forming the outermost panels of each accordian hinged group and the downturned guard flanges 31 are formed on the ends of the ceiling panel sections 28 that form the front and back edges of the assembled metallic ceiling of the portable bumper car ride structure.

By referring again to FIG. 1 of the drawings, it will be seen that a pair of elongated floor sections 32 and 33 are hinged to one another, with the elongated floor section 32 being hinged to one longitudinal side of the floor 10 of the trailer. The arrangement is such that the floor sections 32 and 33 fold up into a side by side vertical position along the sides of the trailer for transport and fold downwardly into a flattened floor as shown in FIG. 2 of the drawings. Duplicate elongated floor sections 32 and 33 are hingedly affixed to one another and to the opposite longitudinal edge of the floor 10 of the trailer and as illustrated in FIG. 1 of the drawings, they are supported by portable legs 34. A railing 35 is positioned on the floor sections 32 and 33 and between the posts 19 and 27 and between the posts 27 and 27 and between the posts 18 and 27, respectively, as shown in the right hand portion of FIG. 1 of the drawings.

In FIG. 2 of the drawings, the hinged outwardly foldable floor sections 32 and 33 on the left hand side of the figure are shown in horizontal position where they align with the floor section 10 of the trailer hereinbefore referred to. It will be understood that the duplicate longitudinally extending floor sections 32 and 33 hinged to the right side of the trailer floor 10 as illustrated in FIGS. 1 and 2 of the drawings extend outwardly in horizontal position beneath the several completely and partially unfolded ceiling panel sections 28 and their metal frames 29.

It will thus be seen that a portable bumper car ride structure has been disclosed which incorporates an elongated over-the-road trailer having vertically spaced floor and ceiling sections 10 and 24 respectively, which in folded portable transport position measures 45 feet in length, 8 feet wide and 13 feet, 4 inches in height, and when unfolded and erected, the floor and ceiling areas are approximately 40 feet by 60 feet. A canvas tent-like top is preferably installed over the uppermost portion of the structure and an ornamental decoration is attached to the outer edges of the I-beams 26 on the front and back portions of the structure and to the outer ends of the I-beams 26 on the opposite sides of the structure. Ramps may be installed at an incline between the supporting ground surface and the upper surface of the goose neck platform 17 to produce a durable amusement ride structure which is quite attractive and which as hereinbefore described is entirely portable when the goose neck-platform 17 is elevated, secured in position and affixed to the 5th wheel of a towing tractor or similar vehicle.

Having thus described my invention what I claim is:

1. An improvement in a portable bumper car ride structure, said structure including a trailer having fixed floor and ceiling sections and a plurality of fold out floor sections hingedly affixed to one another and to the fixed floor section and a plurality of fold out ceiling sections hingedly affixed to one another and to said fixed ceiling section of said trailer, said floor and ceiling sections being metallic and forming electrical conductors for energizing a plurality of bumper cars positioned on said floor sections and having trolleys engaging said ceiling sections, the improvement comprising means supporting said fold out floor and ceiling sections and means for preventing the trolleys of the bumper cars from becoming disengaged from the fold out ceiling sections when the same are folded out, said portable bumper car ride structure comprising said trailer, said fixed floor and ceiling sections and said fold out floor and ceiling sections, said means supporting said fold out ceiling sections and for preventing the trolleys of the bumper cars from becoming disengaged from the fold out ceiling sections including horizontally spaced longitudinally extending trusses supporting said fixed ceiling section of said trailer, fixed support means on said trailer supporting said longitudinally extending trusses, longitudinally spaced sidewardly extending brackets on said trusses, support beams removably engaged in said brackets and positioned sidewardly of said fixed ceiling section, said ceiling sections hinged to one another in accordian fold relationship, rollers on the sides of said fold out ceiling sections movably engaging said support beams and a plurality of angularly positioned guard flanges on the respective outer free edges of said ceiling sections, said fold out ceiling sections being movable from a first vertical position between said brackets and against the outer opposite sides of said longitudinally extending trusses to a horizontal second position between said support beams.

2. The improvement in a portable bumper car ride structure set forth in claim 1 and wherein a fixed elevated rear end portion of said trailer provides vertical clearance for ground engaging wheels and suspension means therefor positioned below and engaged on said elevated portion to support said trailer.

3. The improvement in a portable bumper car ride structure set forth in claim 1 and wherein a vertically movable platform is movably attached to one end of said trailer and movable from a first position level with said fixed floor section of said trailer to a second position above the level of said fixed floor section.

4. The improvement in a portable bumper car ride structure set forth in claim 1 and wherein a portion adjacent one end of said trailer is elevated with respect to said fixed floor section and ground engaging wheels and suspension means therefor are positioned below and engaged on said elevated portion of said fixed floor section to support said trailer and wherein a vertically movable platform is movably attached to the other end of said trailer and movable from a first position level with said fixed floor section of said trailer to a second position above said level of said fixed floor section, whereby said platform serves as a goose neck for removable engagement with a towing vehicle.

5. The improvement in the portable bumper car ride struture set forth in claim 1 and wherein said support beams removably engaged in said bracket and extending sidewardly of said fixed ceiling section are I-beams with portions of the upper flanges of said I-beams cutaway adjacent said brackets so as to provide areas through which the rollers on the sides of said fold out ceiling panels move when said ceiling panels move from a first vertical position between said brackets and alongside said longitudinally extended trusses to a horizontal second position between said support beams with said rollers between upper and lower chords of said I-beams.

* * * * *